United States Patent [19]

Mueller et al.

[11] 4,302,947

[45] Dec. 1, 1981

[54] HEAT PUMP SYSTEM DEFROST CONTROL

[75] Inventors: Dale A. Mueller, St. Paul; Stephen L. Serber, New Hope, both of Minn.

[73] Assignee: Honeywell Inc., Minneapolis, Minn.

[21] Appl. No.: 109,742

[22] Filed: Jan. 4, 1980

[51] Int. Cl.[3] ..... F25D 21/06

[52] U.S. Cl. ..... 62/155; 62/156

[58] Field of Search ..... 62/155, 156, 234, 209, 62/140

[56] References Cited

U.S. PATENT DOCUMENTS 2,081,479 5/1937 Fink ..... 62/156 X 4,209,994 7/1980 Mueller et al. ..... 62/209

*Primary Examiner*—Albert J. Makay

*Assistant Examiner*—Harry Tanner

*Attorney, Agent, or Firm*—Roger W. Jensen

[57] ABSTRACT

A control system for a reverse cycle refrigeration system for controlling the defrosting of the outdoor coil thereof on a cost effective basis; the control system comprising a controller means receiving inputs indicative of the temperature of the outdoor coil, and the operation of the compressor means; the controller means having a timing function which is initiated upon the outdoor coil temperature being at or below a preselected value and the compressor means being operated; the duration of the timing function being determined on a substantially continuous basis as a function of the magnitude of the outdoor coil temperature; and the controller means having an operative connection to the system so as to, upon completion of the timing function, place the reverse cycle refrigeration system into an outdoor coil defrost mode of operation.

4 Claims, 4 Drawing Figures

HEAT PUMP SYSTEM DEFROST CONTROL

BACKGROUND OF THE INVENTION

One of the well known and long standing problems associated with heat pumps is that the outdoor coils thereof will, under normal circumstances, have frost accumulate thereon during the heating mode of operation. The overall efficiency of the heat pump system decreases significantly as the frost thickness increases; the decrease in efficiency results in valuable energy being wasted. Accordingly, many schemes have herefore been proposed for both detecting the frost and for taking corrective action so as to remove the frost from the outdoor coil. Examples of prior art systems include the following U.S. Pat. Nos.: 3,170,304; 3,170,305; and 3,400,553. Another prior art arrangement for solving the above stated problem is that disclosed in the co-pending application of Dale A. Mueller and Stephen L. Serber, Ser. No. 954,141, filed Oct. 24, 1978, now U.S. Pat. 4,209,994; this application discloses an arrangement for utilizing the temperatures of the outdoor air and the outdoor coil to modify the timing function for activation of the defrost mode of operation. In said co-pending application the primary temperature reference is the outdoor air temperature.

The present invention is an improvement over the arrangement disclosed in said co-pending application in that it dispenses with the outdoor air temperature sensor and relies only on the measurement of the outdoor coil temperature, using that temperature to approximate the temperature of the outdoor air for computation purposes of determining the timing function for initiating defrost. The present invention is a less costly system; it is an object of this invention therefore to provide a new, significantly improved and cost effective defrost control system for a reverse cycle refrigeration system.

SUMMARY OF THE INVENTION

The present invention is an outdoor coil defrost control system for a reverse cycle refrigeration system comprising the usual refrigerant compression means, indoor coil, outdoor coil, and refrigerant conduit means interconnecting the compression means and the coils. In particular, the outdoor coil defrost system comprises outdoor coil temperature sensing means having an output indicative of the temperature of the outdoor coil, means for producing an output signal indicative of the operation of the compression means, and a special controller means. The special controller means has operative connections to the above recited temperature sensor and compression means operation sensor so as to receive the outputs thereof. The controller has a timing function which is initiated upon the outdoor coil temperature being at or below a preselected value and the compression means being operated. The duration of the timing function is determined on a substantially continuous basis as a function of the magnitude of the outdoor coil temperature. The controller means has an operative connection to the reverse cycle refrigeration system and is adapted, upon completion of the timing function, to place the system into an outdoor coil defrost mode of operation so as to remove accumulated frost.

DESCRIPTION OF THE PREFERRED EMBODIMENT

Figure 1:
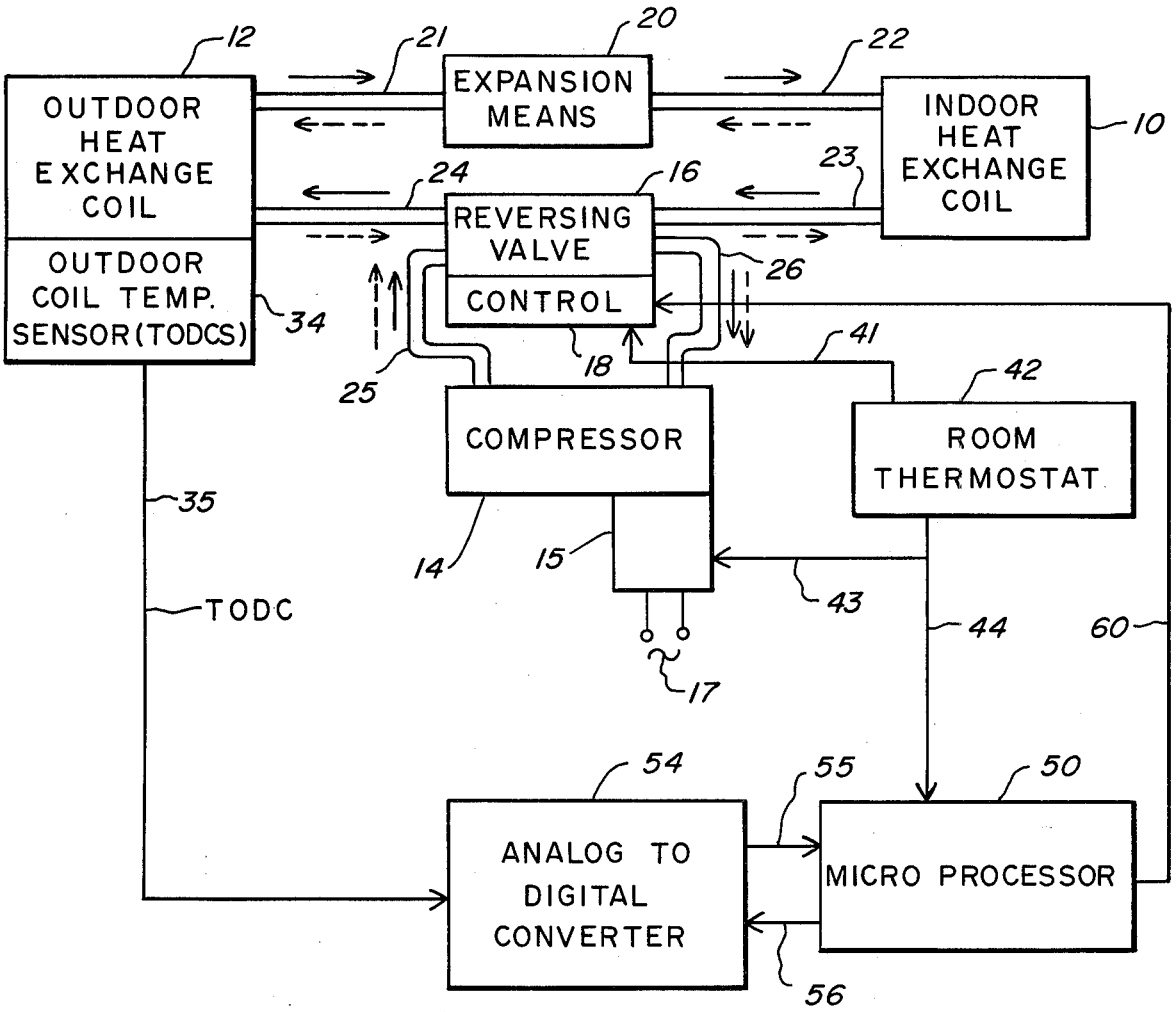
FIG. 1 is a block diagram of the reverse cycle refrigeration system which embodies the present inventions.

FIG. 1 shows a block diagram of a reverse cycle refrigeration system including a system for controlling the defrosting of the outdoor coil thereof; the refrigeration system comprises an indoor heat exchange coil 10, an outdoor heat exchange coil 12, a refrigerant compression means or compressor 14, and refrigerant conduit means interconnecting the coils and the compressor, the refrigerant conduit means including a reversing valve 16 having a control thereof 18, an expansion means 20, and appropriate piping 21–26. The system as thusfar described is old in the art and is exemplified by the above identified patents and application; e.g. U.S. Pat. No. 3,170,304. A brief description of the function of the system is that, during the indoor heating mode, i.e., when the reverse cycle system is working to heat the inside of a building, then compressor 14 will operate to discharge relatively hot gaseous refrigerant through pipe 25, reversing valve 16 and pipe 23 to the indoor heat exchange coil 10 from which heat is transferred to the inside of the building. During the cooling mode of operation, the reversing valve 16 is operated so that the hot gaseous refrigerant from the compressor is routed via pipe 25 reversing valve 16 and pipe 24 to the outdoor heat exchange coil 12 from which the heat is transferred to the outdoor air thus cooling the refrigerant which is then routed through the expansion means 20 and thence to the indoor heat exchange coil 10 where heat from the building is transferred to the relatively cold refrigerant and in this manner the building space is cooled.

The defrost control system comprises an outdoor coil temperature sensing means 34 which hereinafter may sometimes be referred to as "TODCS", the sensor 34 having an output lead 35 on which is available an output signal indicative of the temperature of the outdoor coil, said signal sometimes hereinafter being referred to as "TODC". Lead 35 is connected to an analog to digital converter 54 which functions to convert the analog temperature signal appearing at the input thereof into a digital form which appears on the output 55 thereof applied as the input to a suitable microprocessor 50.

Compressor 14 is controlled by a controller 15 adapted to be energized from a suitable source of supply of electrical power 17 and to be controlled from a rest or "off" position to an operating or "on" condition as a function of either heating or cooling command control signals being applied thereto from a suitable controller such as a room thermostat 42 connected thereto through an interconnecting lead or means 43. The reversing valve 16 is also controlled by a connection 41 from the room thermostat 42 so as to be in the appropriate position for the mode of operation being commanded by the thermostat, i.e., either heating or cooling. The output from the room thermostat 42 is also applied through a connection 44 as another input to the microprocessor 50. The microprocessor 50 also has an output 56 which is applied to the analog to digital converter 54. Further the microprocessor 50 has an output 60 which is applied to the control 18 of reversing valve 16 so as to control the mode of operation of the reverse cycle refrigeration system, i.e., an output from microprocessor 50 via connection 60 may command either heating or cooling of the system, it being understood that commanding the cooling mode will cause the melting and dispersal of any frost on the outdoor coil which frost had accumulated during the prior period of time during which the system was in the heating mode of operation.

A microprocessor which may be used as a component in the present system is the Intel Corporation Model 8049; an appropriate analog to digital converter which may be used as item 54 is Texas Instruments Inc. Model TL505C (see Texas Instruments BULLETIN DL-5 12580); a platinum film resistance type temperature sensor Honeywell Inc. Model C800-B may be used for TODCS 34; and Honeywell Inc. Model T872 type thermostat may be used for room thermostat 42. Further an appropriate heat pump which may be used for components 10, 12, 14, 15, and 16 depicted in FIG. 1 is the Westinghouse Company HI-RE-LI unit comprising an outdoor unit Model No. HLO36COW an indoor unit AGO12HOK.

It will also be understood by those skilled in the art that the functional interconnections depicted in FIG. 1 are representative of one or more electrical wires or pipes, as the case may be, as indicated by the specific equipment used. It will also be understood that the room thermostat means 42 may be referred to as a means which is operatively associated with the compressor 14 and adapted to have an output indicative of the operation of the compressor because operation of the thermostat causes operation of compressor 14 from an "off" to an "on" or operating condition; connection 44 from thermostat 42 to microprocessor 50 thus constitutes an input indicative of compressor operation.

Figure 3:
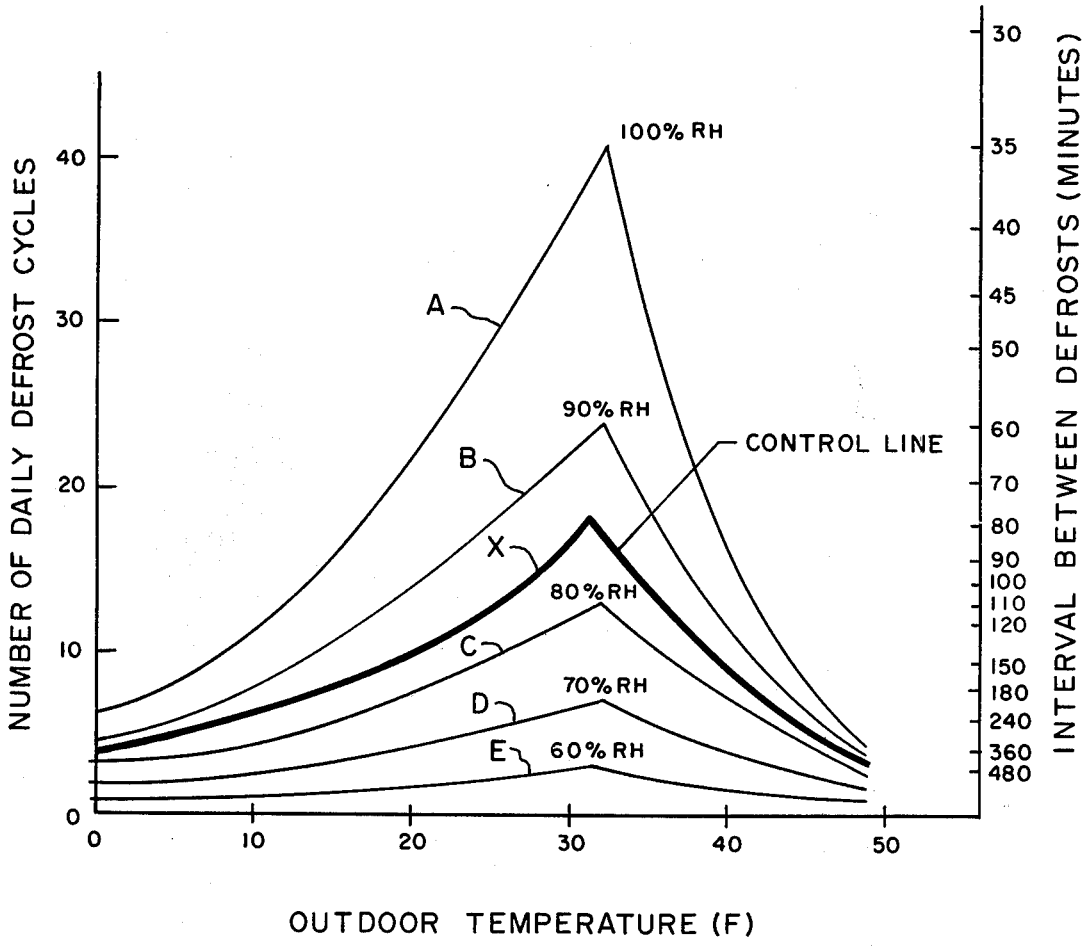
FIG. 3 is a graph showing the relationship between outdoor air temperature and the number of required daily defrost cycles for a typical reverse cycle refrigeration system.

Referring now to FIG. 3, a graph is depicted showing (with reference to the left vertical axis), the number of required daily defrost cycles for a typical heat pump system, and (with reference to the right vertical axis) the interval (in minutes) between defrosts plotted as a function of outdoor temperature (in degrees Fahrenheit), a plurality of graphs A,B, C, D and E showing the required defrost cycles (and intervals of time between defrosts) for outdoor air relative humidities of 100%, 90%, 80%, 70% and 60% respectively. It will be noted that the maximum requirement for defrosting occurs at approximately 32° F. outdoor temperature, and further that defrost frequency requirements increase with an increase in the relative humidity of the outdoor air. The information of the type shown in FIG. 3 was presented in 1962 by James H. Healy in a paper, "The Heat Pump in a Cold Climate", to the 49th Annual Convention of the National Warm Air Heating and Air Conditioning Association. In FIG. 3 the reference graph X is used to depict a control line which is selected for a specific geographical location where a specific heat pump system is to be used; the present invention will follow graph X on a substantially continuous basis to control the initiation of defrosting of the outdoor coil on an optimum, cost-effective basis.

Figure 4:
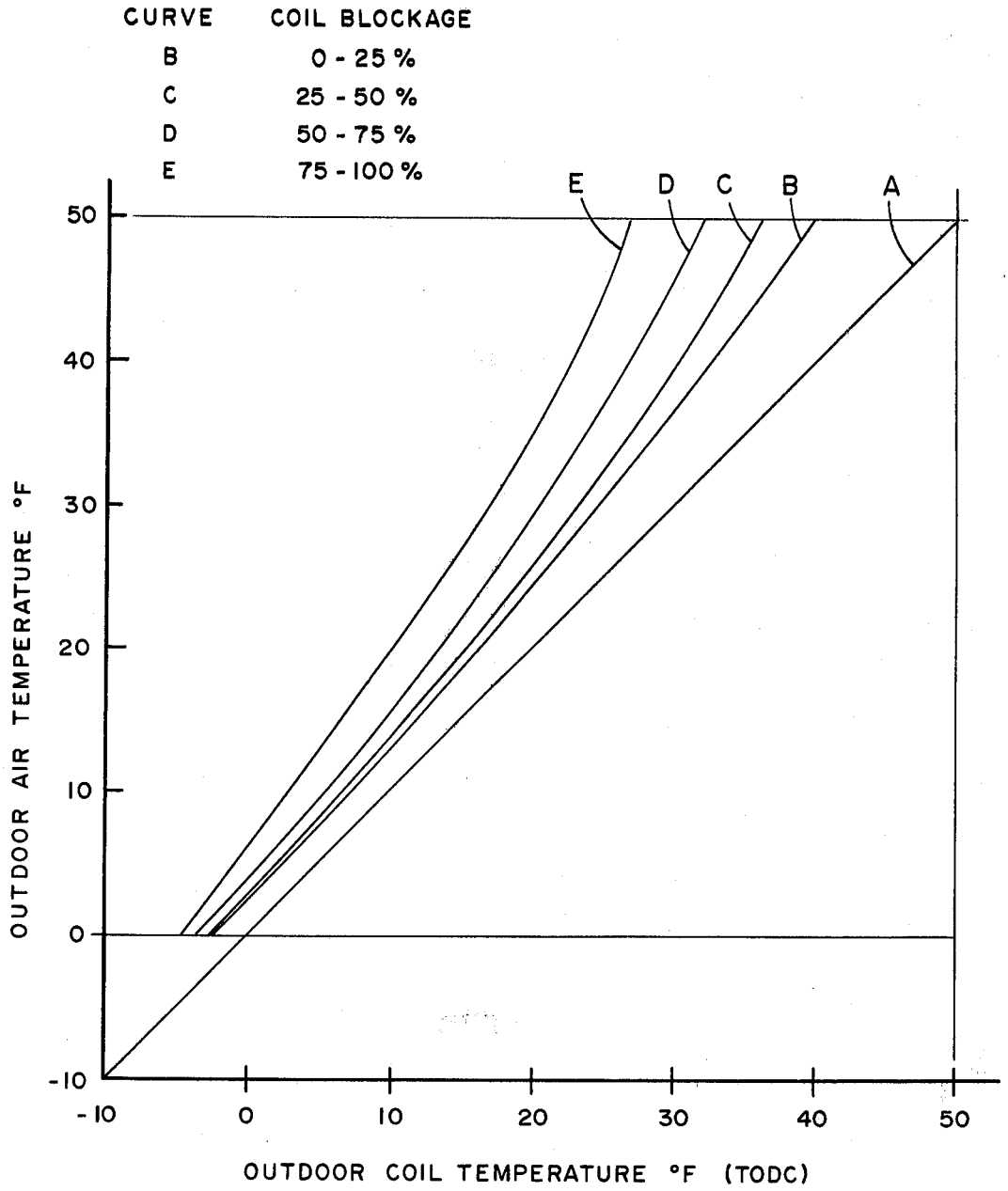
FIG. 4 is a graph showing the relationship between outdoor air temperature and outdoor coil temperature.

FIG. 4 depicts the relationship between the coil temperature (TODC) of a typical heat pump system and the outdoor air temperature, i.e., the temperature of the air adjacent to the outdoor coil of the system; in FIG. 4 curve A shows the theoretical relationship between both temperatures for the case when the outdoor coil has no frost thereon and assumes no loss in the heat transfer between the outdoor air and the coil. The remaining curves B, C, D and E shown in FIG. 4 are respectively the showing of the relationship between the two temperatures for increasing blockages of the coil by frost or ice; more specifically curve B is representative of a blockage in the range of 0–25%, curve C for a blockage in the range of 25–50%, curve D for a blockage in the range of 50–75%, and curve E for a blockage in the range of 75–100%.

It is thus apparent from a study of the data depicted in FIGS. 3 and 4 that first a control line utilizing outdoor temperature may be selected for a given heat pump system in a locality and for a given time of the year, regard further being given to the relative humidity of the air which is to be anticipated for those factors. From FIG. 4 it is seen that measurements of TODC may be used to approximate the temperature of the outdoor air and further may be used to approximate said outdoor air temperature for various known or estimated percentages of blockage of the outdoor coil by frost or ice.

Figure 2:
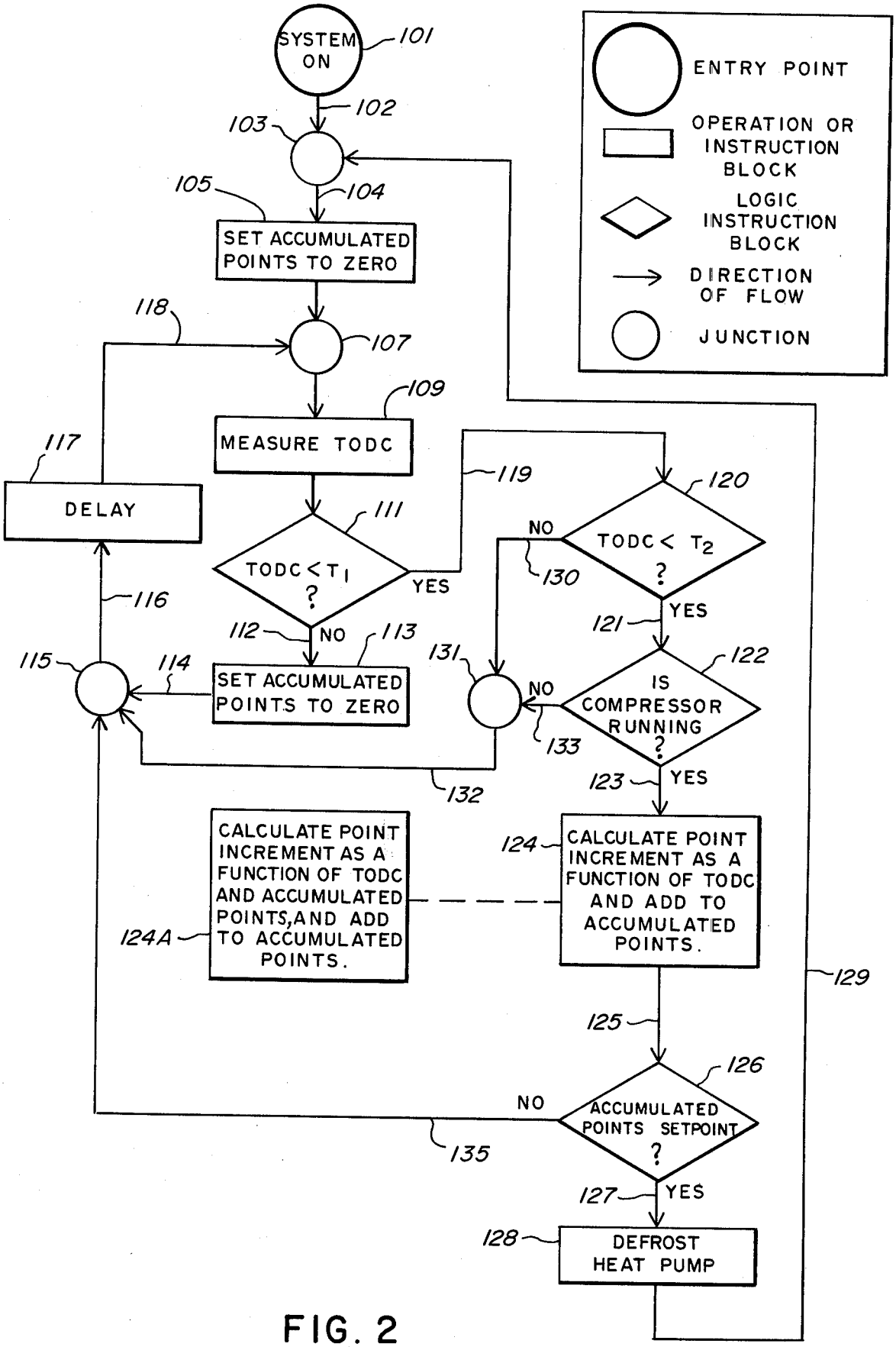
FIG. 2 is a flow chart for the control of the microprocessor depicted in the system shown in FIG. 1.

The detailed operation of the defrost control system of FIG. 1 may be more readily understood by reference to the flow chart of FIG. 2 which shows the flow of operations of microprocessor 50 of FIG. 1. In FIG. 2 the reference numeral 101 designates an entry point "system on" flow from which is via 102 to a junction 103 flow from which is via 104 to an operational instruction block 105 "set accumulated points to zero" flow from which is to a junction 107 and thence to an instruction block 109 "measure TODC" flow from which is to a logic instruction block 111 "TODC is less than $T_1$?" having a "no" output 112 which flows to an instruction block 113 "set accumulated points to zero" flow from which via 114 to a junction 115 and thence via 116 to an instruction block 117 "delay" from which flow is via 118 back to junction 107.

The logic instruction block 111 has a "yes" response at 119 which flows to another logic instruction block 120 "TODC is less than $T_2$?" having a "yes" response 121 which flows to another logic instruction block 122 "is compressor running?" having a "yes" response 123 which flows to an instruction block 124 "calculate point increment as a function of TODC and add to accumulated points" flow from which is to a logic instruction 126 "accumulated points greater than set point?" having a "yes" response 127 which flows to an instruction block 128 "defrost heat pump" flow from which is via 129 back to junction 103.

The logic instruction block 120 has a "no" response 130 which flows to a junction 131 and thence via 132 to junction 115. Also logic instruction block 122 has a "no" response 133 which flows to junction 131 and thence via 132 to junction 115. Further logic instruction block 126 has a "no" response 135 which flows to junction 115.

In operation there is no need to be concerned about defrost unless the outdoor coil temperature is less than a predetermined temperature which is identified as temperature $T_1$ in logic instruction block 111; a representative value of temperature T1 would be 38° F. Thus, referring to FIGS. 1 and 2, if TODC is less than 38°, then there will be flow through 109 and 111 to the "yes" response of logic block 111 to logic block 120 which makes the determination of whether or not TODC is less than $T_2$, a further threshold permit temperature; a representative value of which is 32° F. Then a check is made to determine whether or not the compressor is running, this signal is applied to the microprocessor 50 from the room thermostat 42 via connection 44 and, in FIG. 2 logic instruction block 122 is symbolic of the function of determining whether or not the compressor is running; if the compressor is determined to be running then a "yes" response flows at 123 to instruction block 124 which is symbolic of the calculation of the point increment, as a function of the measured TODC, and the addition of such increment to points previously accumulated. Further information on the theory of accumulating such points may be obtained from the aforedescribed co-pending application of the applicants, Ser. No. 954,141. The logic instruction 126 is representative of the function of determining whether the accumulated points are greater than the "setpoint". At the beginning of the heating cycle the frost would not have accumulated sufficiently so at the response from 126 would be a "no" response at 135 flowing via 115, and the delay 117 back to junction 107 so that the process would continue on repetitive basis until such time as the accumulated points exceed the "setpoint"; then the response from 126 would be a "yes" at 127 flowing to block 128 to command the defrost of the heat pump. The defrost would be implemented in FIG. 1 by the output 60 from microprocessor 50 being applied to the control 18 of the reversing valve 16 so that hot refrigerant would be re-directed from the indoor coil and the compressor to the outdoor coil 12 so as to melt the accumulated frost on the outdoor coil. Simultaneously in FIG. 2 the flow from instruction 128 would be applied via 129 back to junction 103 so as to set the accumulated points to zero as at 105 thus conditioning the system to be ready for the next cycle of heating with the attendant accumulation of frost.

If at any time the coil temperature becomes greater than a reference temperature $T_1$ referred to in logic instruction block 111 then the system is reset back to zero, this being accomplished by the "no" response from logic instruction block 111 being applied to instruction block 113. Also it will be understood that if at any time the logic instruction blocks 120 and/or 122 have a "no" response then there will be no further accumulation of points to the previous total; in other words if either TODC becomes greater than reference $T_2$ and/or compressor is no longer running then it is no longer necessary to accumulate points until such time as both of those conditions produces a "yes" response at 121 and 123 respectively.

A variation or modification of the basic system depicted in FIG. 2 is that depicted by the special operation or instruction block 124 A "calculate point increment as a function of TODC and accumulated points, and add to accumulated points" which is shown in FIG. 2 as an alternate to operation or instruction block 124. The significance of instruction block 124 A is to provide a slightly more sophisticated system in that it takes into account the changing transfer function between the relationship between the outdoor air temperature and an outdoor coil temperature TODC as a function of increasing blockage of the outdoor coil by frost and/or ice. Thus, as will be understood by one skilled in the art, for each success of increment of time of system operation there will be a corresponding incremental increase in the amount of frost on the outdoor coil with an attendant change in the transfer function between the outdoor coil and the outdoor air. The modified system which utilizes 124 A will therefore more precisely develop an estimate of outdoor air temperature as a function of outdoor coil temperature so as to calculate the optimum time to initiate the defrost of the heat pump.

As indicated above, an Intel Model 8049 microprocessor may be used to practice the subject invention; as an assistance reference may be made to "INTEL MCS-48 TM Family of Single Chip Microcomputers—User's Manual", a 1978 copyrighted manual of the Intel Corporation, Santa Clara, Calif. 95051.

Those skilled in the art will further recognize that the outdoor coil temperature may be sensed, as discussed above with a temperature sensing means or may be derived from secondary information such as the pressure of the fluid in the outdoor coil; accordingly, the expression "outdoor temperature sensing means" should be construed herein to include all means which either directly or indirectly produce an output indicative of the temperature of the outdoor coil.

While we have described a preferred embodiment of the invention, it will be understood that the invention is limited only by the scope of the following claims.

We claim:

1. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

outdoor coil temperature sensing means (hereinafter "TODCS") having an output indicative of the temperature of said outdoor coil (hereinafter "TODC");

means (hereinafter "COM") operatively associated with said compression means and adapted to have an output indicative of the operation of said compression means; and controller means having operative connections to said TODC and COM so as to receive the outputs thereof, said controller having a timing function which is initiated upon (i) the outdoor coil temperature as sensed by TODC being at or below a preselected value and (ii) said compression means being operated, the duration of said timing function being determined on a substantially continuous basis by the magnitude of the outdoor coil temperature as sensed by TODCS, and the duration of the timing function of said controller means being further determined by a succession of calculations of points (based on instantaneous value of TODC), and the addition of each such calculation of the preceding total, such calculations continuing until the total of points is greater than a preselected number of points, and said controller means having an operative connection to said system and including means responsive to said point total exceeding said predetermined number and thereupon effective to place said system into an outdoor coil defrost mode of operation.

2. An outdoor coil defrost control system (hereinafter "defrost control system") for a reverse cycle refrigeration system (hereinafter "system") for heating and cooling a building wherein said system comprises refrigerant compression means, an indoor coil, an outdoor coil, and refrigerant conduit means connecting said compression means and said coils, said defrost control system comprising:

outdoor coil temperature sensing means (hereinafter "TODCS") having an output indicative of the temperature of said outdoor coil (hereinafter "TODC");

means (hereinafter "COM") operatively associated with said compression means and adapted to have an output indicative of the operation of said compression means; and controller means having operative connections to said TODC and COM so as to receive the outputs thereof, said controller having a timing function which is initiated upon (i) the outdoor coil temperature as sensed by TODC being at or below a preselected value and (ii) said compression means being operated, the duration of said timing function being determined on a substantially continuous basis by the magnitude of the outdoor coil temperature as sensed by TODCS, and the duration of the timing function of said controller means being determined by a succession of calculations of points (based on (1) the instantaneous value of TODC and (2) the total of previously calculated points), and the addition of each such calculation to the preceding total, such calculations continuing until the total points is greater than a preselected number of points, and said controller means having an operative connection to said system and including means responsive to said point total exceeding said predetermined number and thereupon effective to place said system into an outdoor coil defrost mode of operation.

3. Apparatus of claim 1 further characterized by said controller means including special terminate means for interrupting the timing function after initiation thereof and for preventing the placement of said system into an outdoor coil defrost mode of operation, said special terminate means becoming effective upon the outdoor coil temperature as sensed by TODC being at or above a preselected value.

4. Apparatus of claim 2 further characterized by said controller means including special terminate means for interrupting the timing function after initiation thereof and for preventing the placement of said system into an outdoor coil defrost mode of operation, said special terminate means becoming effective upon the outdoor coil temperature as sensed by TODC being at or above a preselected value.

* * * * *